United States Patent [19]

Pryor

[11] Patent Number: 4,509,452

[45] Date of Patent: Apr. 9, 1985

[54] APPLICATION OF LIQUID ADDITIVES TO CIGARETTE FILTER TOW

[75] Inventor: James W. Pryor, Winston-Salem, N.C.

[73] Assignee: R. J. Reynolds Tobacco Company, Winston-Salem, N.C.

[21] Appl. No.: 437,654

[22] Filed: Oct. 29, 1982

[51] Int. Cl.[3] ..... B05C 5/00; B05C 9/04

[52] U.S. Cl. ..... 118/234; 118/266; 28/282; 28/283; 427/209; 427/300; 427/429

[58] Field of Search ..... 118/266, 267, 234; 427/209, 300, 429; 28/283, 282

[56] References Cited

U.S. PATENT DOCUMENTS

| | | | |
|---|---|---|---|
| 3,152,011 | 10/1964 | Gerard | 118/211 |
| 3,156,016 | 11/1964 | Dunlap et al. | 19/66 |
| 3,157,536 | 11/1964 | Caines | 118/225 |
| 3,224,453 | 12/1965 | Mahoney et al. | 131/208 |
| 3,306,254 | 2/1967 | Keith | 118/227 |
| 3,411,942 | 11/1968 | Fritz et al. | 117/68 |
| 3,852,007 | 12/1974 | Levers et al. | 425/66 |
| 4,132,189 | 1/1979 | Greve et al. | 118/8 |
| 4,301,579 | 11/1981 | Van den Hoven | 28/282 |
| 4,313,974 | 2/1982 | Greve et al. | 427/209 |
| 4,332,454 | 6/1982 | Hensel et al. | 118/266 |

FOREIGN PATENT DOCUMENTS

| | | |
|---|---|---|
| 2042375 | 9/1980 | United Kingdom . |
| 2054342 | 2/1981 | United Kingdom . |

*Primary Examiner*—Shrive P. Beck

*Attorney, Agent, or Firm*—Herbert J. Bluhm

[57] ABSTRACT

Porous metal filters are adapted for use as liquid applicators for applying a liquid additive to a continuous, multifilament filter tow in connection with the manufacture of filter rods from the tow.

7 Claims, 4 Drawing Figures

APPLICATION OF LIQUID ADDITIVES TO CIGARETTE FILTER TOW

TECHNICAL FIELD

This invention relates to the application of liquid additives to cigarette filter tow in connection with the formation of filter rods suitable for use in the manufacture of filter cigarettes.

BACKGROUND ART

The most widely used filters currently being employed in the manufacture of filter cigarettes are those prepared from a large number of continuous, longitudinally aligned filaments which have been combined and shaped into cylindrical form. The filaments generally used are prepared from cellulose acetate and they are supplied to the filter manufacturer in the form of a compacted bale of filter tow. In order to obtain filters that are as uniform as possible, the filter tow is subjected to various processing steps including steps for separating or spreading out the tow and applying plasticizer thereto.

Two basic methods for applying plasticizer to filter tow are widely used in the industry at the present time. The first method involves passing the filter tow through a chamber provided with spraying devices such as nozzles and centrifugal-type applicators. Apparatus utilizing this method is disclosed, for example, in U.S. Pat. Nos. 4,132,189 and 4,313,974 as well as in U.K. Patent Application Nos. 2,042,375 and 2,054,342. The second basic method of applying plasticizer involves contacting the tow with a surface that is coated with the desired quantity of plasticizer. This second method is exemplified by apparatus disclosed in U.S. Pat. Nos. 3,157,536, 3,306,254 and 3,411,942. For each of these basic methods the filter tow is spread out into a flat band or web configuration before the plasticizer is applied.

In previously disclosed apparatus such as that described in U.S. Pat. No. 3,157,536, the flat band of filter tow is contacted on each side thereof with wicktype applicators which are provided with stainless steel wire mesh surfaces across which the band of tow is moved. Uniform distribution of liquid plasticizer in this apparatus design is achieved by positioning a porous felt layer beneath the stainless steel wire mesh surface. After a period of time, however, deposits tend to build up in the porous felt layer leading to channeling and non-uniform application of plasticizer to the wire mesh surface and the band of filter tow. The subsequent passage of the treated tow through a blooming jet fails to compensate fully for this non-uniform application of plasticizer and the resulting filter rod formed from the tow is of correspondingly lower quality. It is apparent, therefore, that the plasticizer must be distributed on the filter tow as uniformly as possible prior to passage of the tow through the blooming jet. Consequently, the use of applicators such as those disclosed in U.S. Pat. No. 3,157,536 requires frequent cleaning if satisfactory operation is to be obtained.

BRIEF SUMMARY OF THE INVENTION

This invention provides an improved method and apparatus for applying a liquid additive to cigarette filter tow by contacting the tow with a surface that is wetted with the liquid additive.

It is a principal object of this invention to adapt porous metal filters for use as liquid applicators in applying a liquid additive to cigarette filter tow.

It is a further object of this invention to provide a method and apparatus for continuously applying uniform amounts of a liquid additive to a continuous multifilament tow preparatory to moving the tow through a filter rod-forming process.

It is a further object of this invention to provide a method for applying a liquid additive to cigarette filter tow while the tow is simultaneously being subjected to a tow spreading or diverging action.

Other objects and advantages of the invention will be apparent from the detailed description which follows.

DETAILED DESCRIPTION OF THE INVENTION

Figure 1:
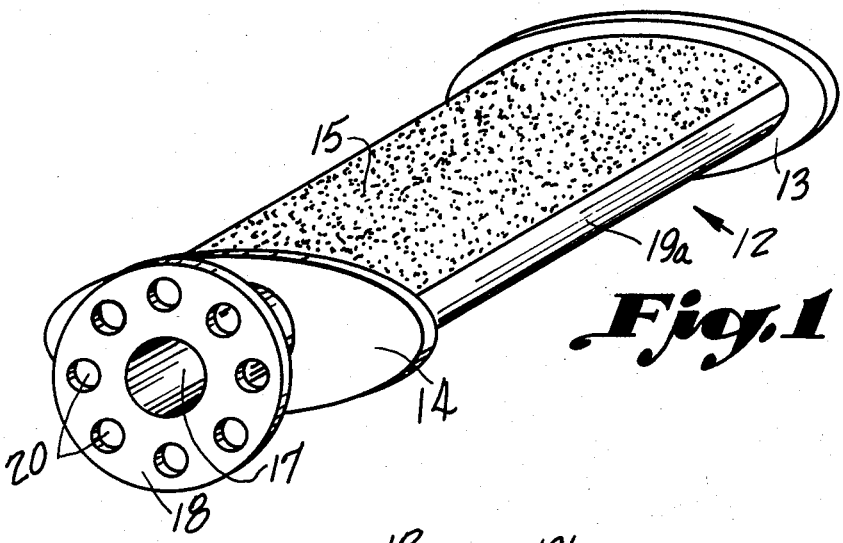
FIG. 1 is a perspective view of a porous metal filter adapted for use with this invention.

The present invention provides an improved method for applying a liquid additive such as a plasticizer to a substantially flat band of continuous, multifilament filter tow by advancing the tow in a longitudinal direction across a porous surface of a liquid applicator that is wetted with the liquid additive and wherein the liquid applicator comprises a porous metal filter provided with means for supplying the liquid additive to the porous metal filter. Simply stated, this invention involves passing a measured quantity of liquid additive through a porous metal filter and contacting a substantially flat, thin band of filter tow moving in its longitudinal direction with the surface of the porous metal filter from which the liquid additive is emerging. Porous metal filters suitable for use with this invention are commercially available from a number of suppliers. Surprisingly, it has been found that porous metal filters may be used for applying liquid additives to filter tow over extended periods of time without significant channeling or build-up of deposits in the filter that would affect the application of the additives to the tow. Moreover, they require only minimum modification to adapt them for use in the application of accurately controlled amounts of liquid additives to filter tow.

Porous metal filters are usually made by forming metal particles or powder into the desired shape and subsequently heating or sintering the shaped filter under controlled conditions. They may be fabricated from a variety of metals although bronze and stainless steel are most commonly used. For the purposes of the present invention it is preferred that stainless steel filters be used and that the surface of the filter across which the tow moves be convex in shape. Porous metal filters which have a cylindrical or semicylindrical shape are satisfactory. Also suitable are elongated filters which have an oval or elliptical cross sectional shape. Although porous metal filters have a relatively smooth surface, the surface should preferably be filed or rubbed with an abrasive (e.g., emery paper) prior to use with the filter tow to remove any sharp metal edges that could damage the tow or interfere with movement of the tow across the surface of the filter. The porous metal filter must also be provided with means for introducing liquid additive into the core of the filter at rates which are controlled with respect to the speed of the filter tow moving across the surface of the metal filter.

In adapting porous metal filters for use in the application of liquids to filter tow, porous metal should be used only for the surface that is actually contacted by the tow. If commercial porous metal filters are used having, for example, a cylindrical shape, that portion of the filter surface which is not actually contacted by the filter tow should be sealed by suitable means. Thus, a layer of paint, epoxy glue, solder or other suitable material may be applied to selected portions of the surface of the porous metal to prevent flow of liquid additive through that portion of the surface which has been coated.

For a better understanding of this invention, reference will now be made to the drawings which show certain aspects of this invention in more detail.

Figure 2:
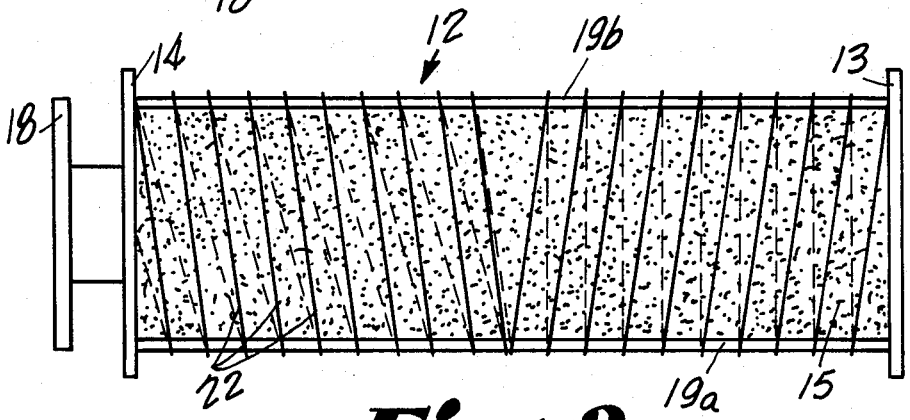
FIG. 2 is a plan view of a modified form of porous metal filter.

FIGS. 1 and 2 show a porous metal filter having a substantially oval or elliptical cross sectional shape. The body 12 of the filter is provided with end plates 13 and 14 which are welded, soldered or otherwise securely attached to each end of the filter body for the purpose of limiting the lateral movement of the band of filter tow. The numerous pores or openings on the surface 15 of the filter body are in communication with an elongated cavity located within the filter body 12. Plasticizer or other liquid additives are introduced into this cavity via passageway 17 associated with flange 18. Flange 18 is also provided with a circular row of holes 20 for mounting the porous metal filter onto a mating flange associated with conventional tow processing apparatus (not shown). Weld bead 19*a* is a band of solid metal which overlies the abutmentline between two opposing halves of the filter body 12 which are usually joined by a welding process in commercially produced porous metal filters.

In a particularly preferred embodiment of this invention, surface 15 of filter body 12 is provided with means for exerting a tow spreading action on a band of filter tow moving across surface 15. The means for exerting a spreading action comprises wire 22 (FIG. 2) spirally wound around filter body 12 in such a way that the individual windings of wire on one half of filter body 12 diverge toward end plate 13 and on the other half of filter body 12 the windings diverge toward end plate 14 as viewed from weld bead 19*a* of filter body 12. It is apparent that placement of the wire windings on surface 15 will be influenced by the orientation of filter body 12 in the tow processing apparatus. If, for example, the advancing tow were to make initial contact with weld bead 19*b* and proceed across surface 15 to weld bead 19*a*, the wire windings would exert a converging action on the moving band of tow. The diameter of the wire used for winding around the filter body is not particularly critical. Wire diameters of approximately 0.025 cm. to 0.25 cm. may be used although it is preferred that wire diameters of 0.040 cm. to 0.090 cm. be employed. It is also apparent that a tow diverging action can be achieved by other structural features such as a series of ridges formed directly in the surface of the porous metal filter.

Figure 3:
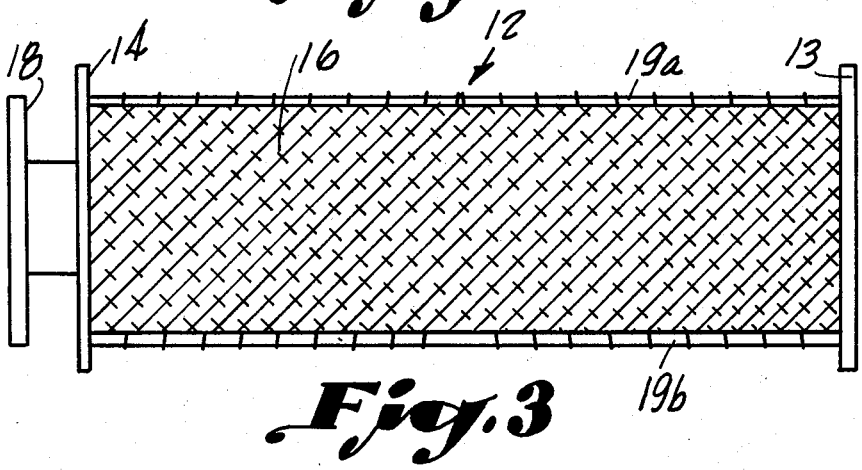
FIG. 3 is the opposing plan view of the modified porous metal filter shown in FIG. 2.

FIG. 3 shows the modified porous metal filter of FIG. 2 as viewed from the side opposite to that on which the wire windings are exposed. The surface of the filter shown in FIG. 3 is treated with an epoxy glue coating 16 to seal the pores and prevent liquid additive from passing through the coated portion of the porous metal filter. It is convenient to coat also the wire windings on the coated side of the porous metal filter so that the wire is essentially concealed and held firmly in place as indicated by FIG. 3. Alternatively, one of the two halves of filter body 12 may be fabricated from nonporous metal thereby making a coating of epoxy glue or other sealer unnecessary.

Figure 4:
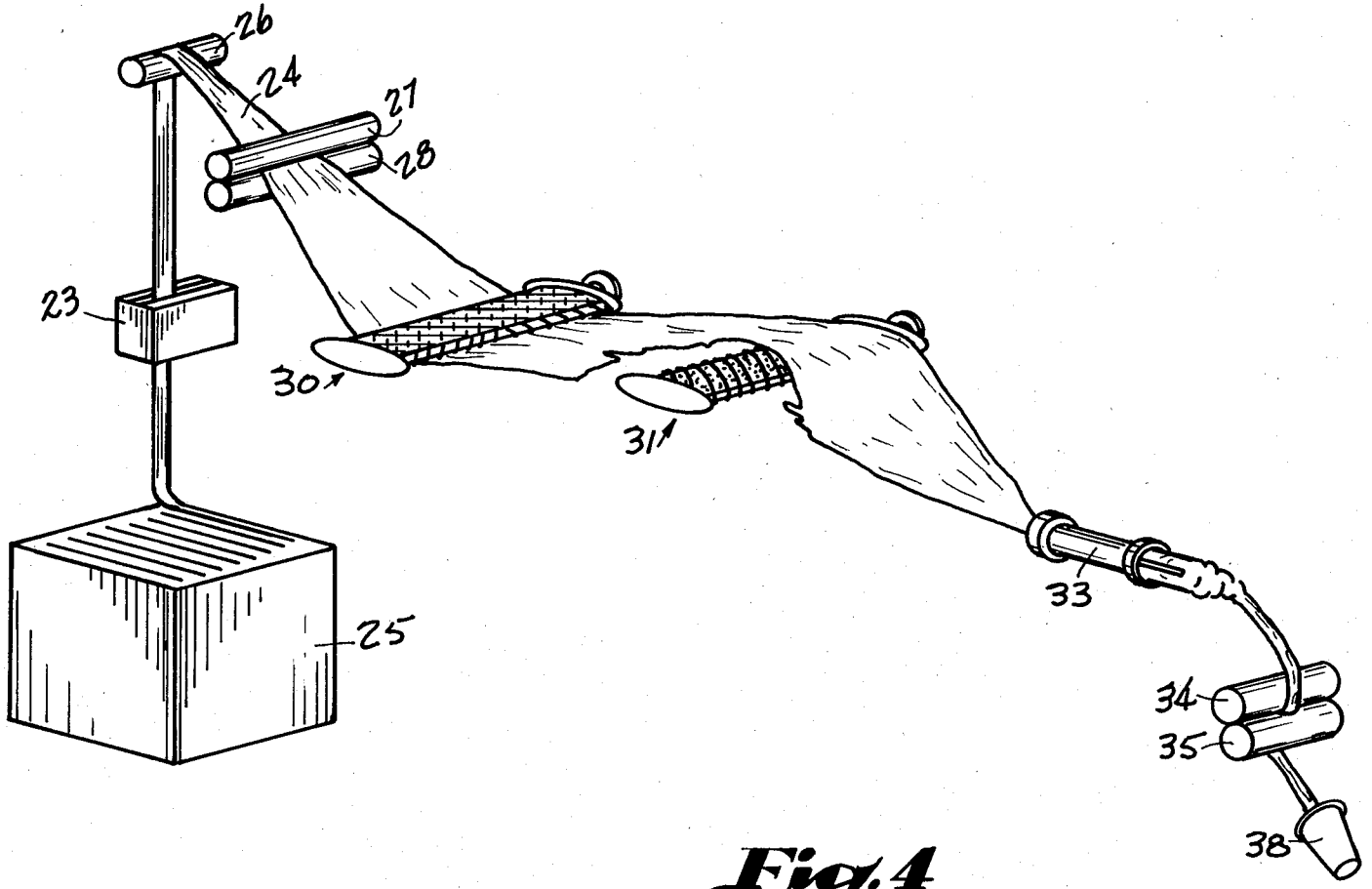
FIG. 4 is a perspective view partially in section of apparatus for processing filter tow.

FIG. 4 depicts apparatus for treating filter tow prior to forming the tow into a continuous filter rod. A continuous multifilament tow 24 is withdrawn from tow supply container 25 by feed rolls 27 and 28 with the tow passing through pneumatic banding jet 23 and over guide roll 26 after it is withdrawn from container 25. Banding jet 23 and guide roll 26 serve to establish an essentially flat, thin band of filter tow for application of plasticizer. Plasticizer applicators 30 and 31, which are porous metal filters that have been modified as shown in FIG. 2, apply plasticizer to each side of the band of tow as the tow moves in contacting relationship sequentially across the porous surface of each applicator. The high velocity gas stream passing through blooming jet 33 exerts sufficient tension on the filter tow to move the tow across applicators 30 and 31. After the plasticized tow has been bloomed by blooming jet 33, it moves between delivery rolls 34 and 35 before proceeding to the garniture section of the filter rod forming device which is depicted by 38. The relative positions of applicators 30 and 31 with respect to the advancing tow must be such that good contact between the band of tow and the applicator surface is maintained. The arrangement shown in FIG. 4 is somewhat simplified for purposes of illustration but it is obvious to those skilled in the art that additional or alternative processing steps may be incorporated into this arrangement. For example, the tow may be directed between additional rolls for applying tension to the tow before plasticizer is applied. Also, it is apparent that plasticizer applicators 30 and 31 may be adapted for use with tow processing apparatus such as that disclosed in U.S. Pat. No. 3,852,007 thereby rendering the plasticizer applicator and housing used with that apparatus unnecessary.

The effectiveness of the presently disclosed invention was demonstrated by incorporating two porous metal filters, modified as shown in FIG. 2 and described herein, into an E-60 tow processing set-up developed by Eastman Kodak Company. The porous metal filters were obtained from Pall Trinity Micro Corporation of Cortland, New York (Part No. B-14-06G) and they were fabricated from type G stainless steel. The average pore size of the porous metal was 10 microns and the filter body was wrapped with 0.0508 cm. diameter stainless steel wire in a pattern similar to that shown in FIG. 2. A coating of epoxy glue was applied to the filter surface that was not in contact with the filter tow. The E-60 set-up was operated in a conventional manner with the treated cellulose acetate tow being immediately directed into the garniture of a filter rod making machine designed to manufacture non-wrapped cellulose acetate filter rods. For comparison purposes a conventional E-60 tow processing set-up employing wick-type applicators with stainless steel wire mesh screens was similarly used to convert cellulose acetate tow into non-wrapped filter rods. A visual inspection of the non-wrapped filter rods formed in each case made it readily apparent that the porous metal filters adapted for use as plasticizer applicators gave a more uniform distribution of plasticizer on the tow as evidenced by a peripheral surface on the filter rod that was substantially less frayed.

While certain embodiments of this invention have been described above, other modifications will be apparent to those skilled in the art without departing from the spirit and scope of the appended claims.

What is claimed is:

1. Apparatus for applying a liquid additive to a moving band of continuous, multifilament filter tow comprising a liquid applicator provided with a porous metal surface adapted for contacting said band of filter tow, means for supplying controlled amounts of liquid additive to said porous metal surface, means for continuously moving the band of filter tow in contacting relationship across said porous metal surface and wherein said porous metal surface is provided with tow spreading means comprising a plurality of ridges arranged at angles which are inclined with respect to the path of the moving band of filter tow so that the filter tow is urged to move laterally from the central portion of the band of filter tow to each edge of said band of filter tow.

2. The apparatus of claim 1 wherein said ridges comprise wire windings arranged in substantially fixed position on the porous metal surface.

3. The apparatus of claim 2 wherein the diameter of the wire in said wire windings is between 0.025 cm. and 0.25 cm.

4. The apparatus of claim 2 wherein the diameter of the wire in said wire windings is between 0.040 cm. and 0.090 cm.

5. Apparatus for continuously applying liquid plasticizer to a moving, essentially flat, thin band of a continuous, multifilament filter tow comprising two cooperating porous metal filters positioned so that each side of said band of filter tow is contacted sequentially with the porous surface of one of the porous metal filters, means for advancing the band of filter tow in a longitudinal direction across the porous surface of each porous metal filter, means for supplying amounts of liquid plasticizer to each porous metal filter that are controlled with respect to the moving band of filter tow and wherein said porous surface of each porous metal filter is provided with tow spreading means comprising a plurality of ridges arranged on the porous surface of each porous metal filter at angles which are inclined with respect to the path of the moving band of filter tow so that the filter tow is urged to move laterally from the central portion of the band of filter tow to each edge of said band of filter tow.

6. The apparatus of claim 5 wherein said ridges comprise wire windings arranged in substantially fixed position on the porous metal filter, the diameter of the wire in said wire windings being between 0.025 cm. and 0.25 cm.

7. The apparatus of claim 5 or 6 wherein the cross sectional shape of the porous metal filter body is substantially oval or elliptical.

* * * * *